US006843547B2

(12) United States Patent
Adkins et al.

(10) Patent No.: US 6,843,547 B2
(45) Date of Patent: Jan. 18, 2005

(54) MISSING NOZZLE DETECTION METHOD AND SENSOR FOR AN INK JET PRINTER

(75) Inventors: Christopher Alan Adkins, Lexington, KY (US); Adam Jude Ahne, Lexington, KY (US); Mark Joseph Edwards, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 374 days.

(21) Appl. No.: 09/907,735

(22) Filed: Jul. 18, 2001

(65) Prior Publication Data

US 2003/0137549 A1 Jul. 24, 2003

(51) Int. Cl.[7] ..... B41J 29/393
(52) U.S. Cl. ..... 347/19
(58) Field of Search ..... 347/19, 6, 7, 63, 347/65, 56, 58, 10, 23, 12, 14, 11; 324/110

(56) References Cited

U.S. PATENT DOCUMENTS

| | | | | |
|---|---|---|---|---|
| 3,810,194 A | | 5/1974 | Tokunaga et al. | 346/75 |
| 4,092,591 A | * | 5/1978 | Lozowski | 324/10 |
| 4,489,335 A | | 12/1984 | Watanabe et al. | |
| 4,509,057 A | | 4/1985 | Sohl et al. | 347/19 |
| 4,737,803 A | | 4/1988 | Fujimura et al. | 346/75 |
| 4,768,045 A | * | 8/1988 | Koto | 347/19 |
| 4,797,688 A | | 1/1989 | Furukawa | 347/6 |
| 4,990,932 A | | 2/1991 | Houston | 347/81 |
| 5,036,340 A | | 7/1991 | Osborne | 347/19 |
| 5,124,720 A | | 6/1992 | Schantz | |
| 5,140,429 A | | 8/1992 | Ebinuma et al. | |
| 5,160,939 A | | 11/1992 | Bajeux et al. | 347/78 |
| 5,164,747 A | | 11/1992 | Osada et al. | 346/140 |
| 5,572,241 A | | 11/1996 | Kanayama et al. | |
| 5,581,284 A | | 12/1996 | Hermanson | |
| 5,627,571 A | | 5/1997 | Anderson et al. | |
| 5,721,574 A | | 2/1998 | Kubby | 347/7 |
| 5,739,832 A | | 4/1998 | Heinzl et al. | 347/68 |
| 5,796,414 A | | 8/1998 | Sievert et al. | 347/19 |
| 5,815,175 A | | 9/1998 | Seikel | 347/23 |
| 5,929,875 A | | 7/1999 | Su et al. | |
| 5,936,645 A | | 8/1999 | Niikura et al. | 347/14 |
| 5,984,455 A | | 11/1999 | Anderson | |
| 5,992,984 A | * | 11/1999 | Imanaka et al. | 347/65 |
| 5,995,067 A | | 11/1999 | Terasawa et al. | 345/23 |
| 6,007,173 A | | 12/1999 | DeLouise et al. | 347/7 |
| 6,010,205 A | | 1/2000 | Billet | |
| 6,039,429 A | | 3/2000 | Balousek | 347/19 |
| 6,062,668 A | | 5/2000 | Cruz-Uribe | 347/19 |
| 6,076,910 A | | 6/2000 | Anderson | |
| 6,120,125 A | | 9/2000 | Kim | 347/19 |
| 6,250,735 B1 | | 6/2001 | Kaneko et al. | 347/19 |
| 6,299,275 B1 | | 10/2001 | Elgee | 347/19 |
| 6,378,978 B1 | | 4/2002 | Chang et al. | 347/19 |
| 6,398,334 B2 | | 6/2002 | Dunand | 347/14 |

* cited by examiner

*Primary Examiner*—Stephen D. Meier
*Assistant Examiner*—Charles W. Stewart, Jr.
(74) *Attorney, Agent, or Firm*—Taylor & Aust, P.C.

(57) ABSTRACT

A method of detecting malfunctioning ones of a plurality of nozzles of a printhead in an ink jet printer includes providing a sensor having at least two terminals defining at least one gap therebetween. An attempt is made to jet ink from a first of the nozzles into the at least one gap. A resistance between at least two of the terminals is measured to determine whether the ink has been jetted into the at least one gap. The attempting and measuring steps are repeated for each remaining nozzle.

14 Claims, 8 Drawing Sheets

190

MISSING NOZZLE DETECTION METHOD AND SENSOR FOR AN INK JET PRINTER

BACKGROUND OF THE INVENTION

1. Field of the Invention

The present invention relates to ink jet printers, and, more particularly, to a method and apparatus for checking the operation of the nozzles in an ink jet printer.

2. Description of the Related Art

Ink jet printhead nozzles are prone to clogging due to dried ink or debris physically impeding the nozzle plate orifice, or due to electrical failure, such as non-functional heater resistors that have failed due to electrostatic discharge, manufacturing defect on the silicon chip, broken TAB bond or chip trace connections, etc.

Even though the printhead ships from the factory with all nozzles testing good, defects including those listed above can occur in shipping, installation, or use of the head. While a head with such a defect is generally still usable, the resultant print quality defects are readily apparent to the user in the form of white lines in the printed pages. This is both a nuisance and a very visible negative contributor to the user's perception of the printer's quality.

Some known printers include a means to sense whether the nozzle/heater resistors read proper resistance. If so, an assumption is made that that nozzle is functioning correctly. Other known printers include a means to print a pattern on the page, each nozzle forming a block or similar pattern in an isolated page position, and moving an optical sensor over the page to sense presence or absence of the printed block or pattern. If a nozzle block is sensed, that nozzle is known to be functional.

Other known printers include means to adjust the printing algorithm so as to account for missing nozzles having been sensed. For instance, a normal print pass might be made, then the paper might be shifted a number of pels, then a second print pass might be made, this time to print the dot positions that were "out" on the first pass.

The drawbacks of the known schemes are that they require fairly expensive circuitry and/or special optical sensors to be used. Also, some require that a test page be printed to determine missing nozzles.

What is needed in the art is a simple, low-cost method and apparatus for performing automatic missing nozzle detection for an ink jet printer.

SUMMARY OF THE INVENTION

The present invention provides a simple, low-cost sensor for sensing whether ink is being emitted from individual nozzles, so that automatic adjustment might be made in printing to compensate for malfunctioning nozzles.

The invention comprises, in one form thereof, a method of detecting malfunctioning ones of a plurality of nozzles of a printhead in an ink jet printer. A sensor has at least two terminals defining at least one gap therebetween. An attempt is made to jet ink from a first of the nozzles into the at least one gap. A resistance between at least two of the terminals is measured to determine whether the ink has been jetted into the at least one gap. The attempting and measuring steps are repeated for each remaining nozzle.

The invention comprises in another form thereof, a sensor for detecting malfunctioning printhead nozzles in an ink jet printer. The sensor includes at least two terminals defining a gap therebetween. An electrical measuring device detects a change in an electrical resistance between two of the terminals when ink is in the gap between the at least two terminals.

An advantage of the present invention is that malfunctioning nozzles are detected and compensated for such that the malfunctioning nozzles are transparent to the user and quality perception remains high.

Another advantage is that the cost of the sensor is much less than that of a reflective, optical-type sensor. The sensing circuit requires just a few low cost components.

Yet another advantage is that only a rough alignment of the sensor in the printer is required for ease of printer manufacturing assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
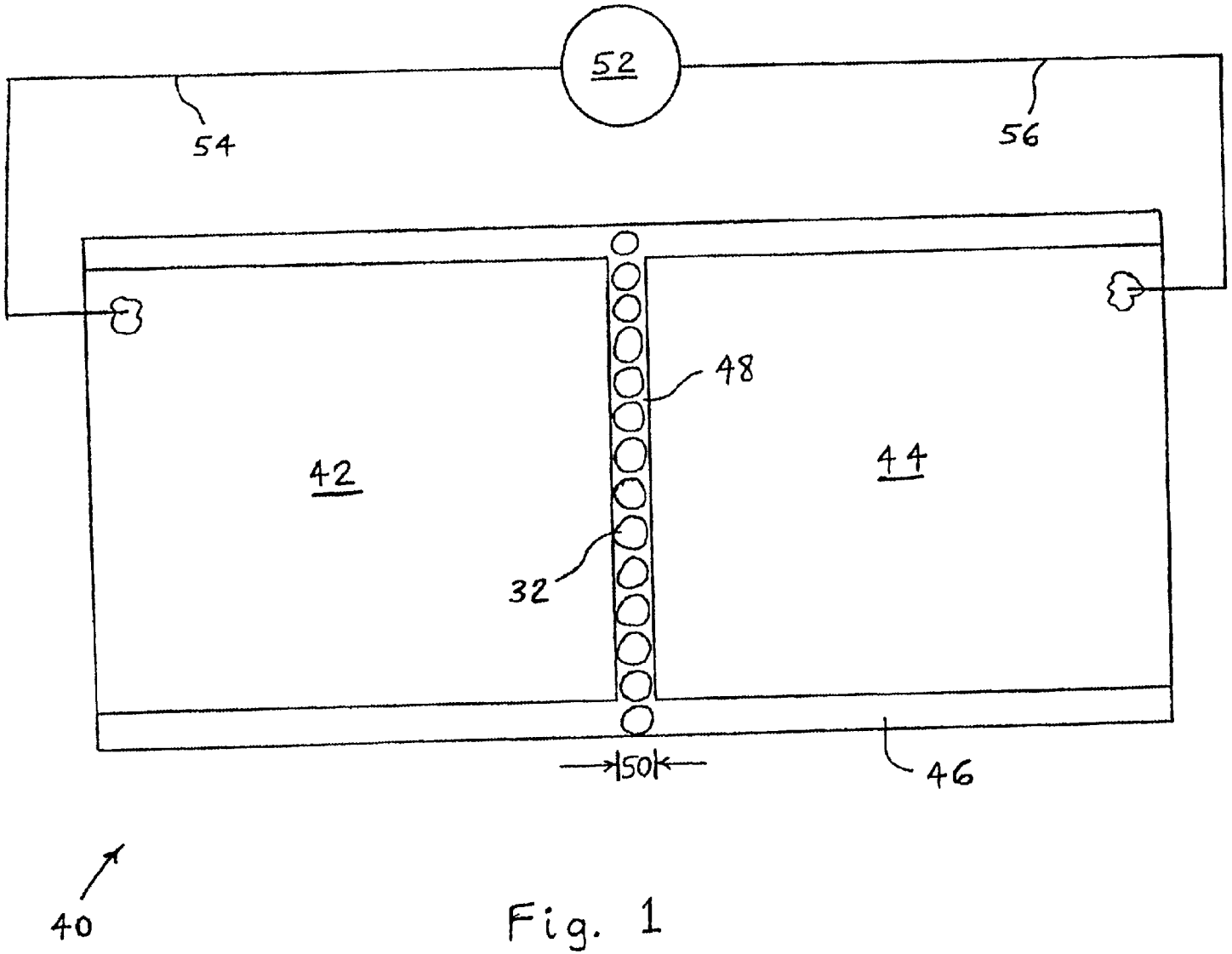
FIG. 1 is an overhead schematic view of one embodiment of a slotted sensor of the present invention.

Referring now to the drawings and particularly to FIG. 1, there is shown one embodiment of a slotted sensor 40 of the present invention, including two copper terminals 42, 44 on a mylar substrate 46. Terminals 42, 44 are separated by a gap 48 having a width 50 of approximately between 1/1200-inch and 1/600-inch, which is approximately the width of an ink droplet 32. Gap 48 can be formed by laser cutting. An ohmmeter 52 has leads 54, 56 connected to terminals 42, 44, respectively, to measure the resistance therebetween. When no ink drops 32 are between terminals 42 and 44, the resistance between terminals 42 and 44 is many hundreds of megohms. If a single column of ink drop 32 is printed from a printhead into gap 48, as illustrated in FIG. 1, the resistance between terminals 42, 44 drops into the range of approximately between 0.5 and 3 megohms. Printing this column of ink drops 32 even one print element (pel) off-center of gap 48 leaves the resistance between terminals 42, 44 at several hundred megohms. One pel is defined herein as the width of one ink droplet. Once printed in gap 48, the ink evaporates within a few seconds, and the resistance returns to several hundred megohms. Thus, slotted sensor 40 is re-usable, i.e., it may be used for several repetitions.

Figure 2:
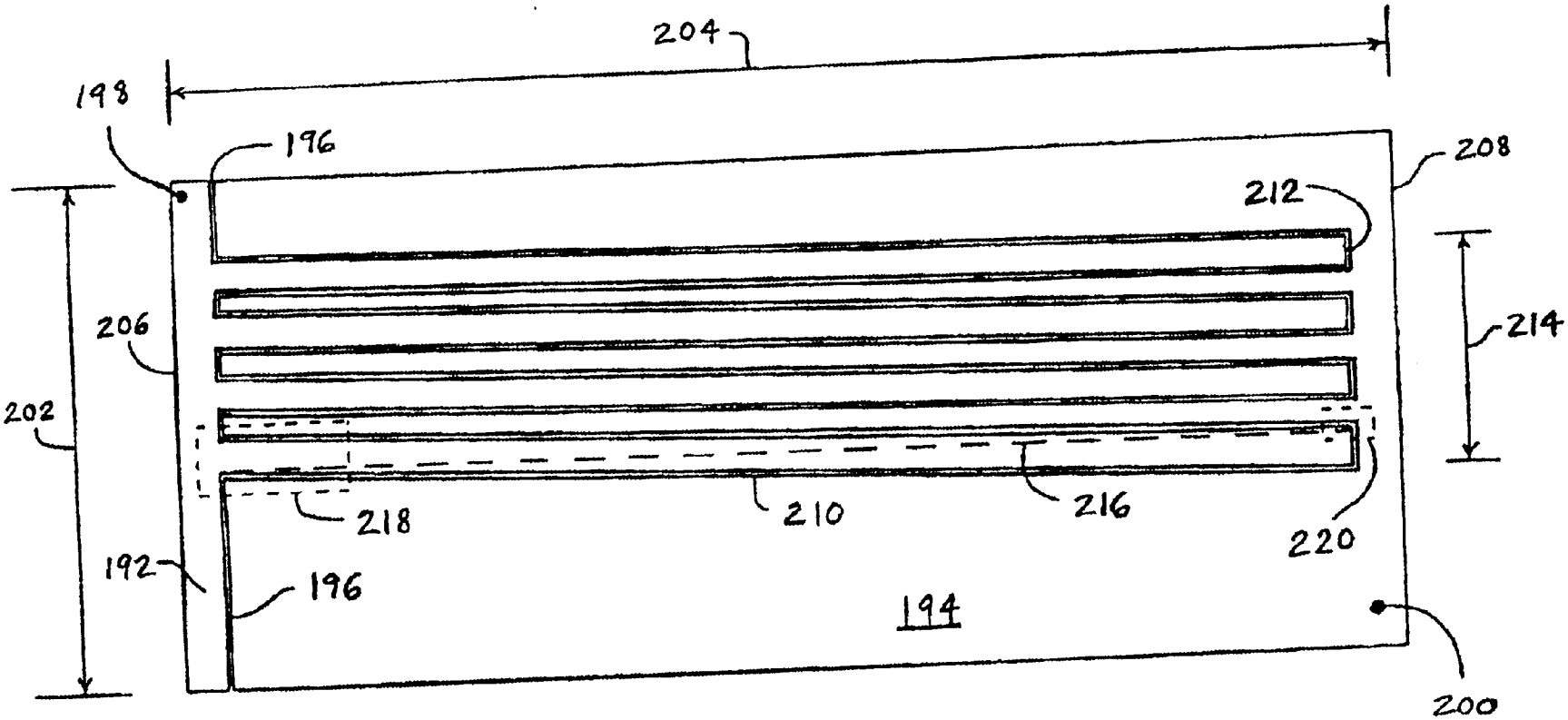
FIG. 2 is an overhead schematic view of another embodiment of a slotted sensor of the present invention.

One embodiment of a missing nozzle sensor 190 (FIG. 2) operates similarly to sensor 40, but is modified to allow detection of missing nozzles in a printhead having a column of 300 nozzles, each spaced vertically one pel apart. Sensor 190 includes two conductive terminals 192, 194 separated by and defining a serpentine gap 196. Terminals 192, 194 have respective contacts 198, 200 to which an ohmmeter may be connected. Each of terminals 192, 194 has a height 202 of approximately 0.75 inch. A distance 204 between a left edge 206 of terminals 192 and a right edge 208 of terminal 194 is approximately 3.6 inches. Gap 196 has eight substantially horizontal sections 210 joined by seven vertical sections 212. A distance 214 between a top horizontal section 210 and a bottom horizontal section 210 is approximately 0.5 inch.

Figure 3:
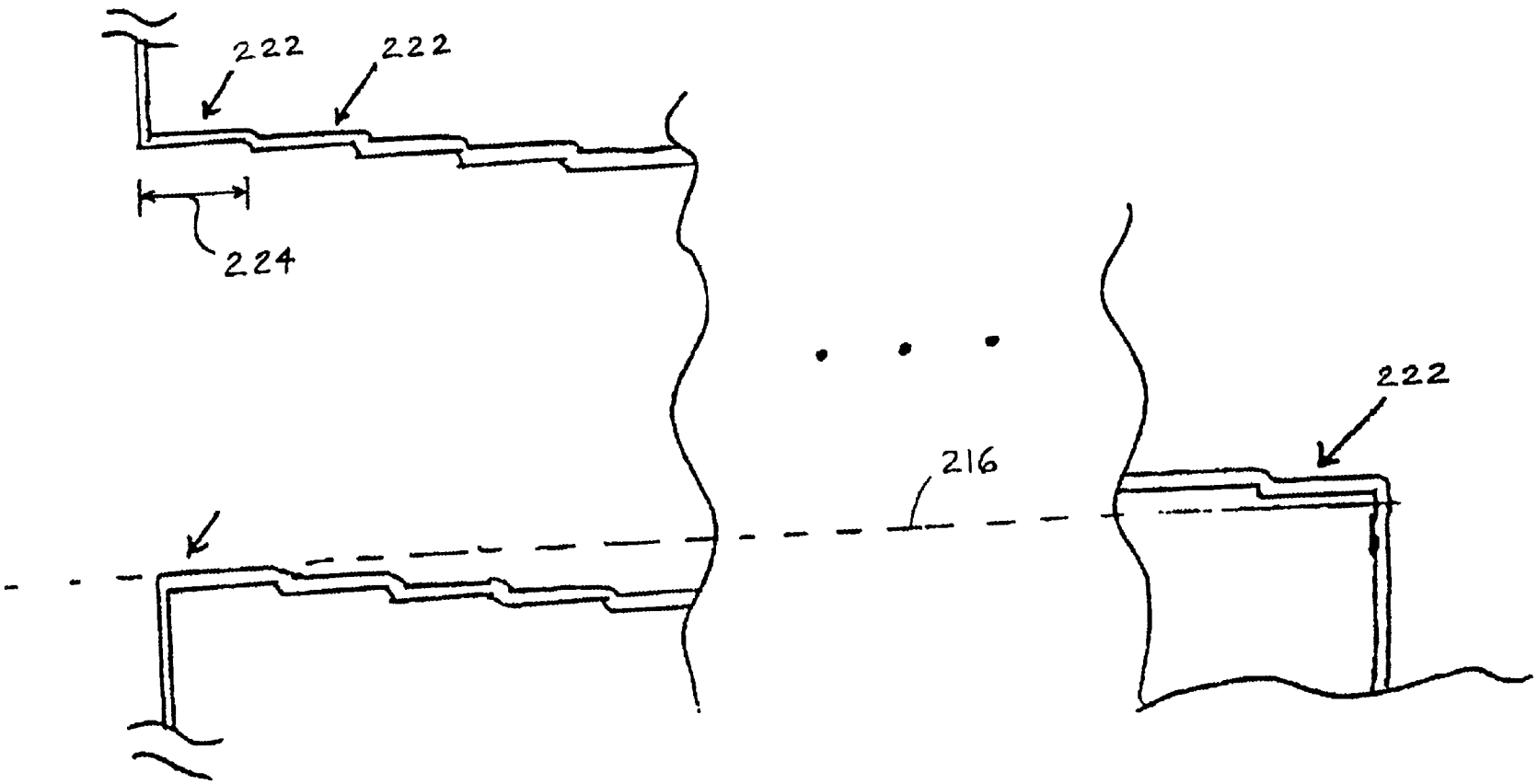
FIG. 3 is an enlarged view of certain areas of the sensor of FIG. 2.

Although each of sections 210 is substantially horizontal, a close inspection reveals that each section 210 is angled slightly downward from left to right. This can be most easily seen by comparing sections 210 with horizontal reference line 216. FIG. 3 illustrates the reason for the left to right downward tilting of sections 210. The left side of FIG. 3 is an enlargement of area 218 of FIG. 2, while the right side of FIG. 3 is an enlargement of area 220. Each section 210 is formed of a series of forty interconnected horizontal segments 222. Each short horizontal segment 222 has a length 224 of eighty pels, i.e., approximately 2 millimeters. Each segment 222 of gap 196 is one pel high and is displaced by one pel in the vertical direction from one or two adjacent segments 222. Each of the forty segments 222 in a section 210 corresponds to a respective nozzle on the printhead. Eight sections 210 are provided to thereby cover the total of 320 nozzles.

Figure 4:
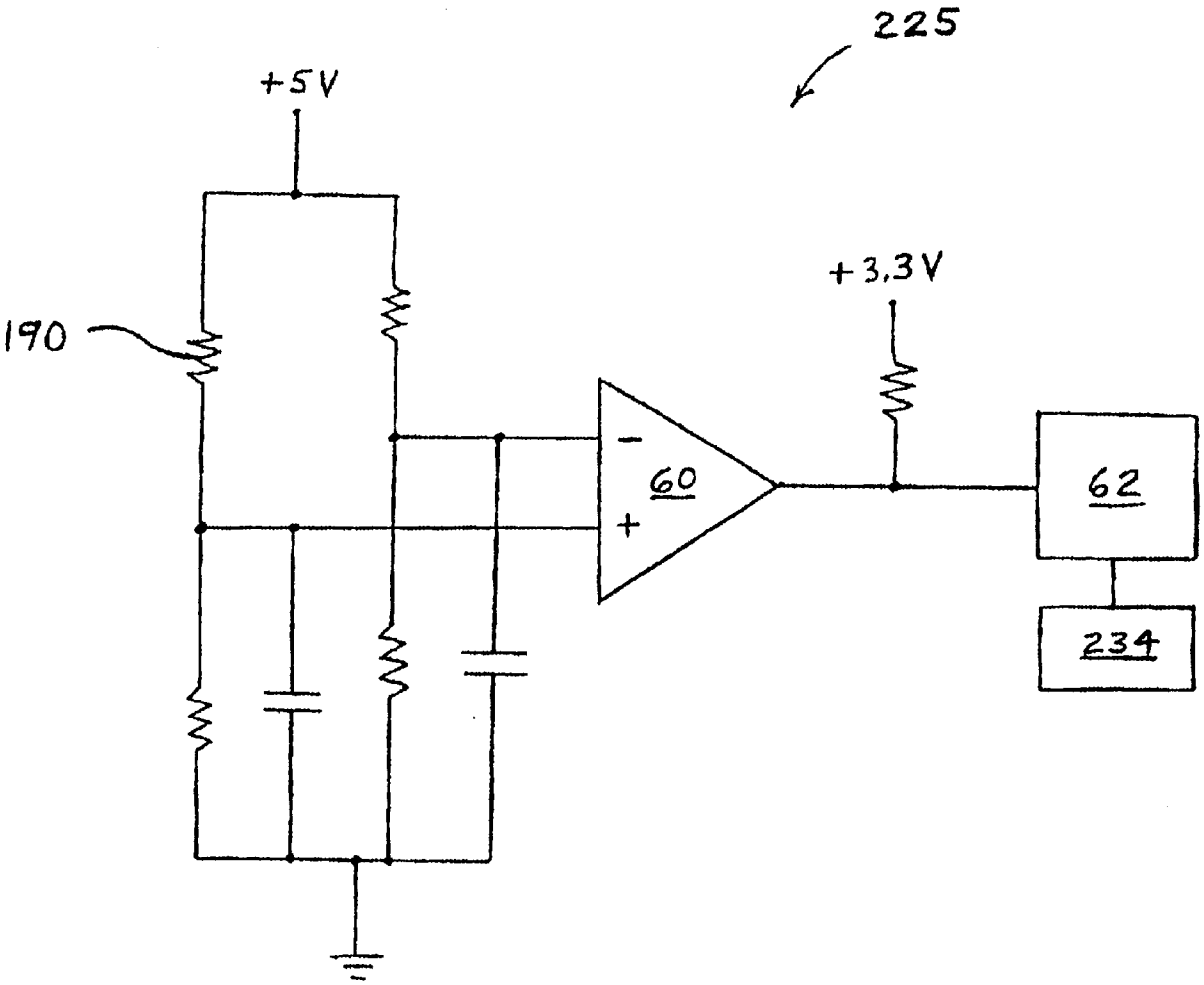
FIG. 4 is a schematic view of one embodiment of a sensing circuit in which the sensor of FIG. 2 can be incorporated.

Sensor 190 can be incorporated in a sensing circuit 225, as shown in FIG. 4. The resistance of sensor 190 is used in a resistor divider in a comparator circuit such that its change from several hundred megohms to just a few megohms causes the output of comparator 60 to go high. This output is fed to the printer application specific integrated circuit (ASIC) 62 to indicate that ink has been jetted into gap 196 of sensor 190.

Figure 5:
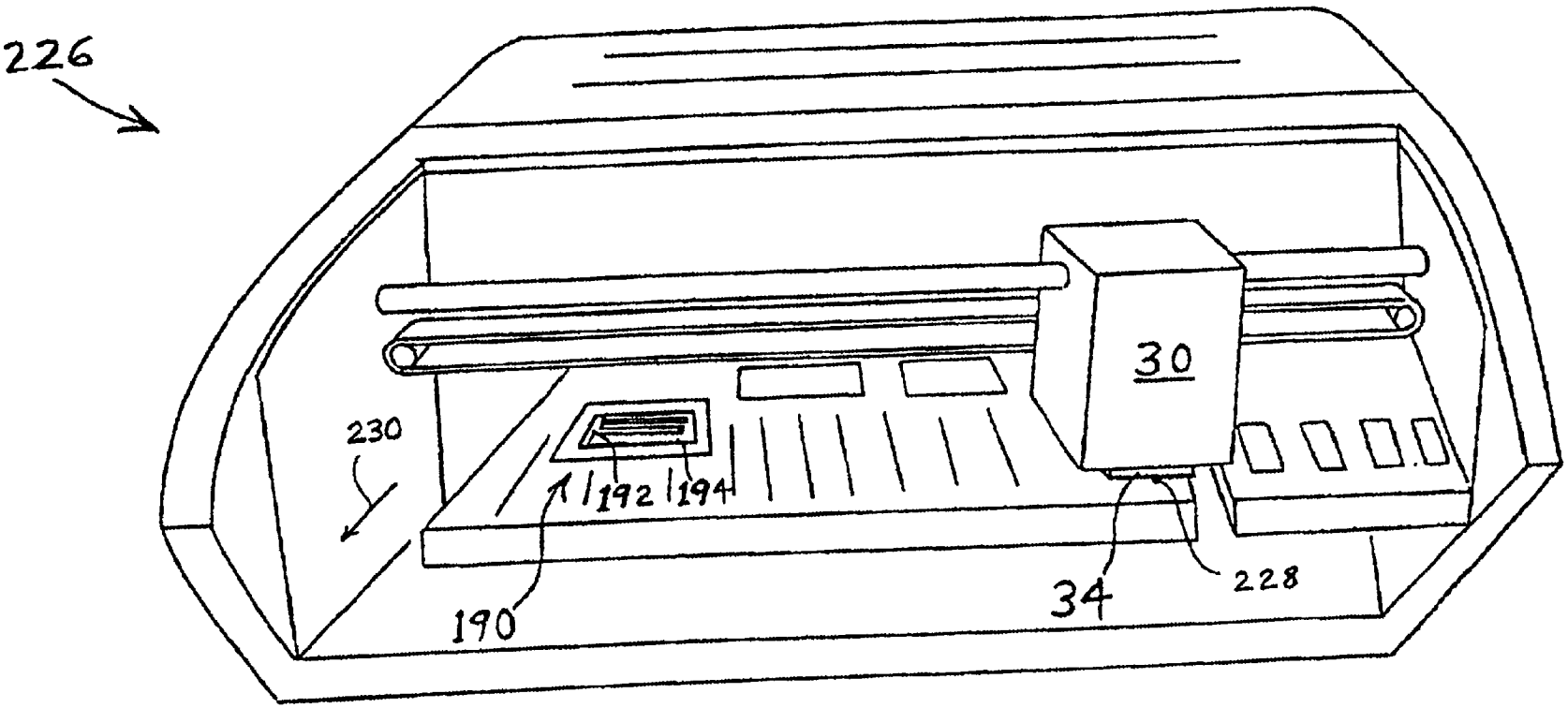
FIG. 5 is a front, sectional, perspective view of an ink jet printer including the sensing circuit of FIG. 4.

In one embodiment of a method of detecting a missing nozzle, re-usable gap sensor 190 is used to sense that a printed single-pel-tall row of seventy ink dots has struck a fixed y-axis position. Sensor 190 is positioned in the horizontal print path of a printhead 34 of a carrier 30 (FIG. 5), in an approximate position specified in software, aligned to within a few pels tolerance. This approximate position of sensor 190 within an ink jet printer 226 is typically known to perhaps ⅛-inch. Printhead 34 has a plurality of nozzles 228 displaced from one another in the vertical (paper feed) direction 230. One of nozzles 228 is visible in FIG. 5.

Figure 6:
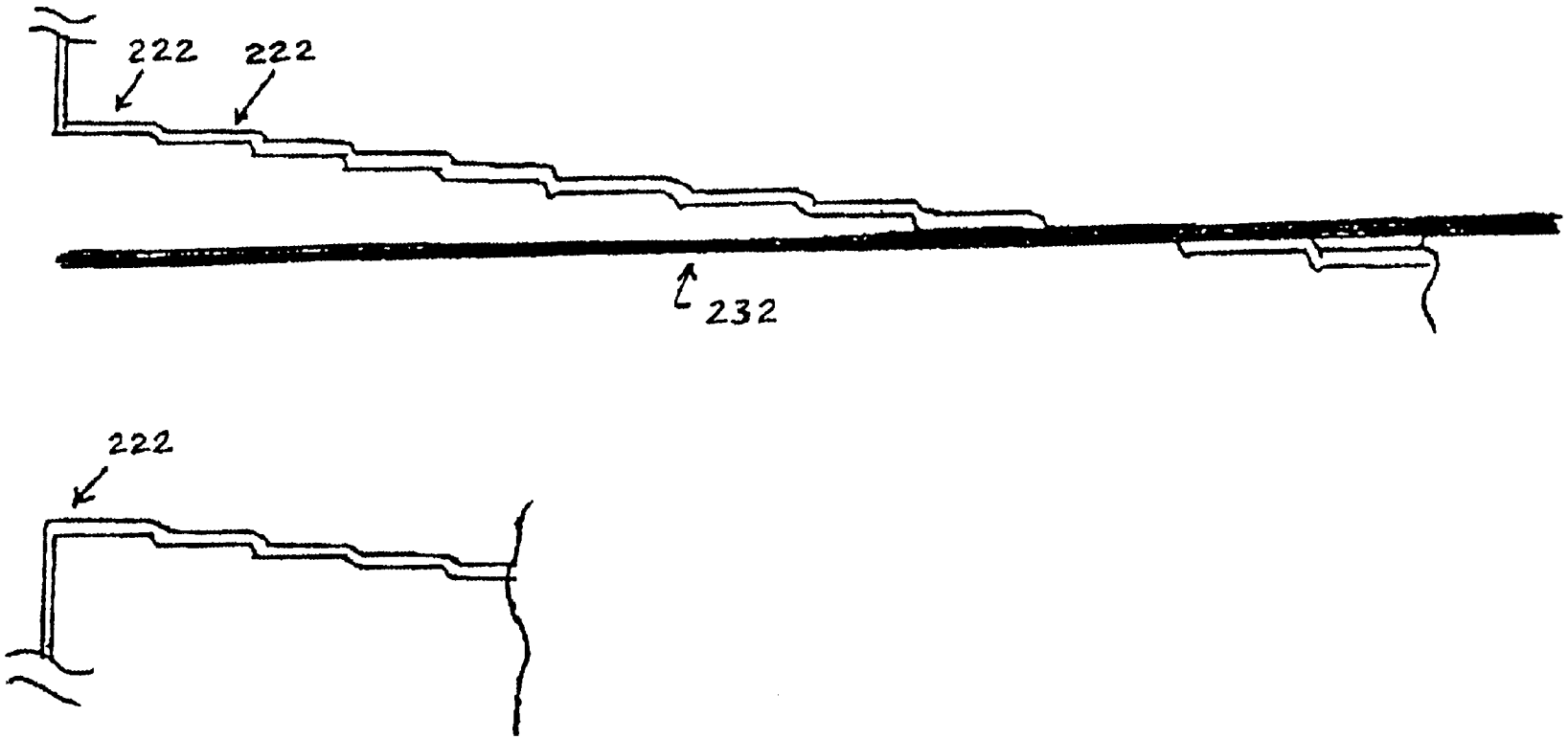
FIG. 6 is an enlarged view of certain areas of the sensor of FIG. 2 with a row of ink dots printed thereacross.

Printer 226 prints a single-pel-high row of ink dots 232 (FIG. 6) across sensor 190 with a first nozzle 228, i.e., an uppermost, leading paper-edge nozzle 228. Print row 232 need only be printed across the x-axis range of the section 210 whose y-axis range includes the y-axis position of the first nozzle 228. After printing row 232, the resistance of sensor 190 is monitored by sensor circuit 225. If the uppermost nozzle is working properly, and actually prints row 232, ASIC 62 reads a positive signal and logs the nozzle as "good" in nonvolatile random access memory (NVRAM) 234. Printer 226 then pauses long enough for printed row 232 to evaporate and for the resistance of sensor 190 to return to its initial large value.

If the uppermost nozzle 228 is deemed to be non-firing, this fact is logged in memory 234. The above procedure including attempting to print a horizontal row of dots, etc., is repeated for each one of the remaining nozzles individually until the first jetting nozzle is identified. In the embodiment described herein, it is assumed that the uppermost nozzle 228 is identified as a jetting nozzle.

Figure 7:
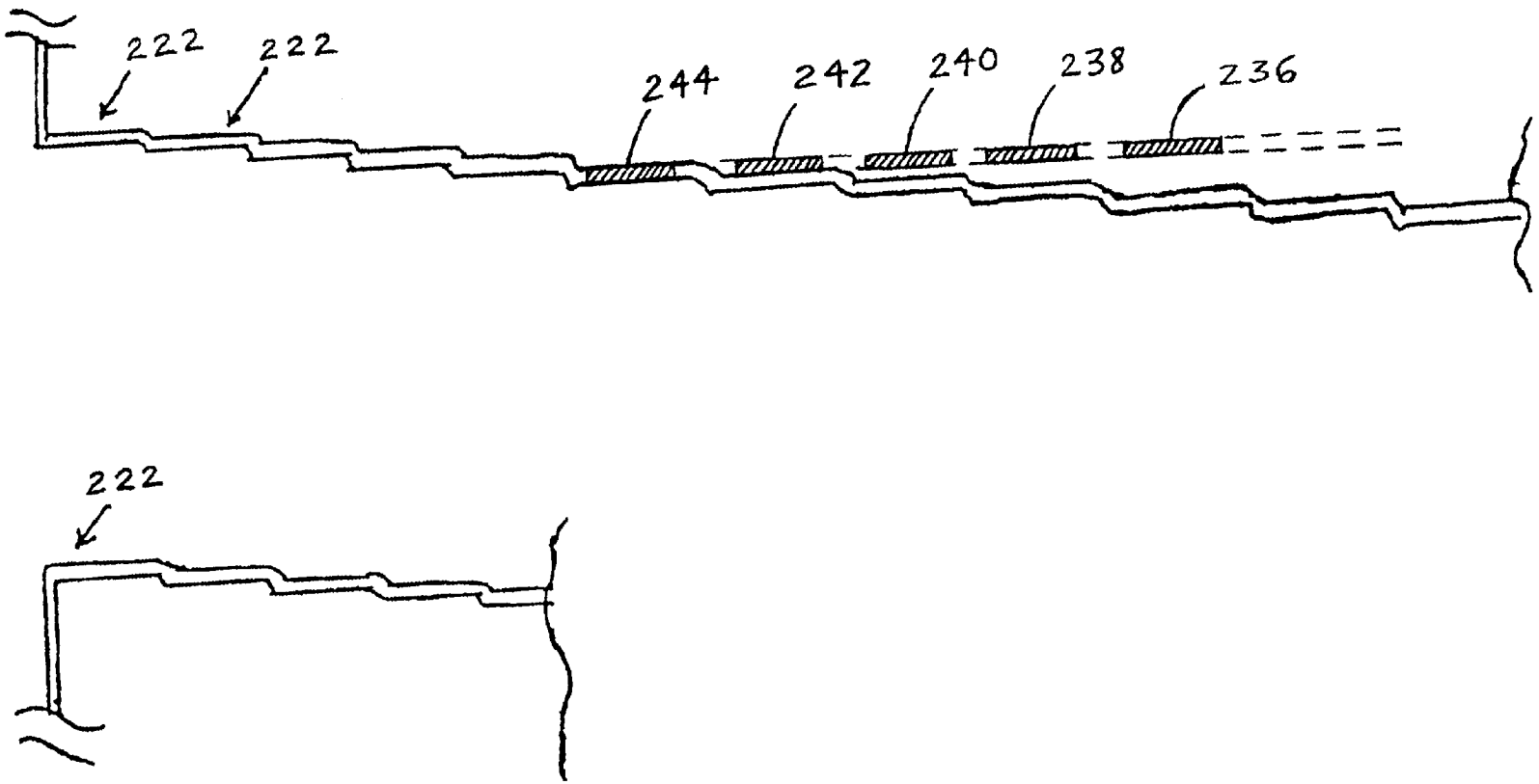
FIG. 7 is an enlarged view of certain areas of the sensor of FIG. 2 with rows of ink dots printed along certain segments of the gap.

Knowing that the uppermost nozzle 228 is a jetting nozzle, printer 226 then uses the uppermost nozzle to print a seventy-pel-long row or set 236 (FIG. 7) of side-by-side pels across the x-axis location of the tenth segment 222 from the left of the uppermost section 210, for instance. After printing row 236, the resistance of sensor 190 is monitored by sensor circuit 225. Since the uppermost nozzle 228 has been tested "good", the uppermost nozzle is assumed to have actually printed. If ASIC 62 reads a positive signal, this locates the uppermost nozzle at the y-direction coordinate of the tenth segment 222 from the left, and allows proper x-axis positioning for the rest of the nozzle fire row print passes.

If ASIC 62 does not read a positive signal, the uppermost nozzle print row is assumed to have printed to the right of sensor gap 196. In this case, after a pause for drying, printer 226 uses the uppermost nozzle to print a row 238 of seventy dots or pels across the x-axis location of the ninth segment 222 from the left of the uppermost section 210. ASIC 62 checks the resistance of sensor 190. If there is still no change in resistance, incrementally leftward rows 240, 242 and 244 are sequentially printed, with ASIC 62 checking the resistance of sensor 190 and allowing time for drying between the printing of each row. After row 244 is printed, ASIC 62 senses a change in resistance of sensor 190, and the starting segment 222, i.e., the sixth segment 222 from the left, is thus located and associated with the uppermost nozzle 228.

Figure 8:
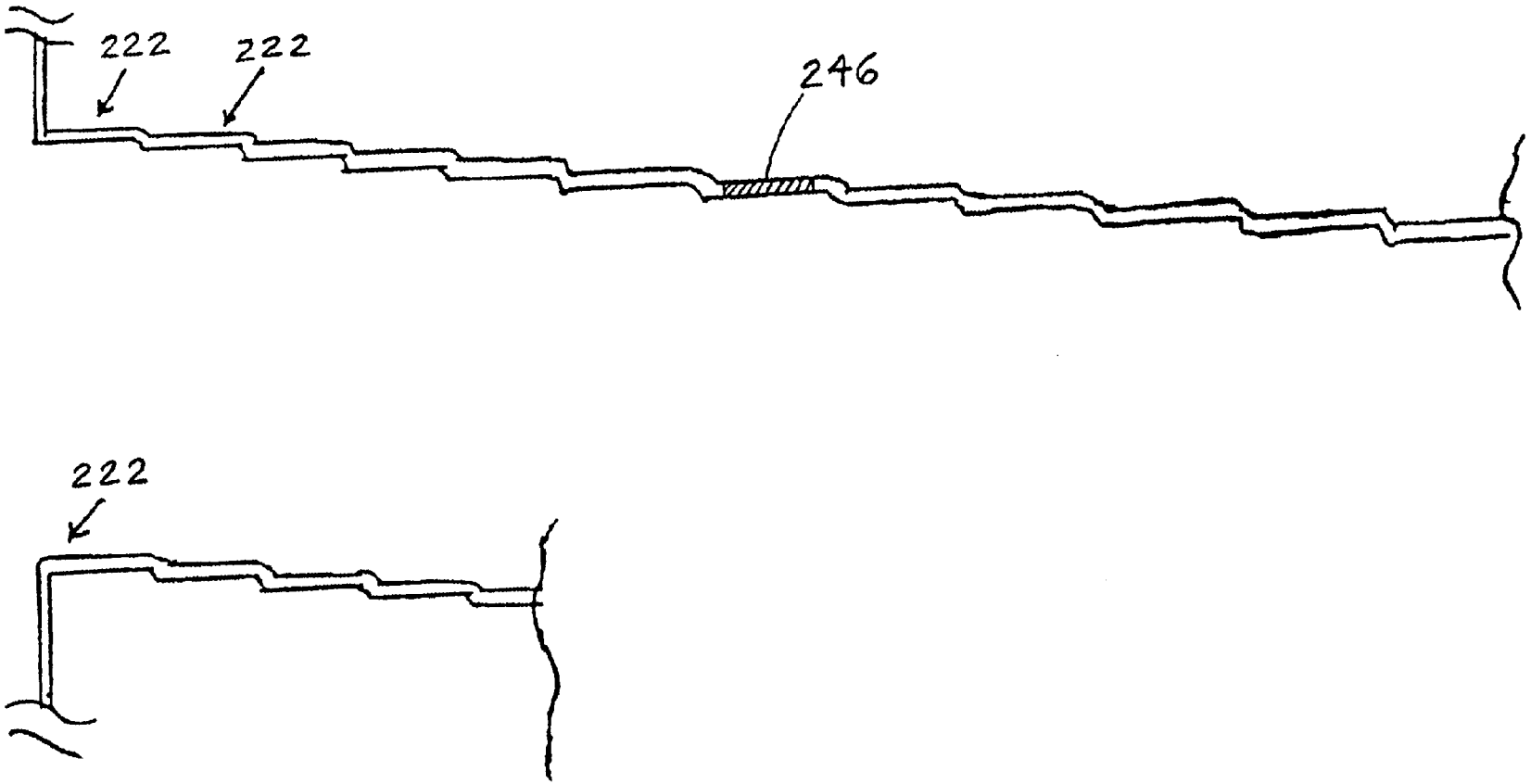
FIG. 8 is an enlarged view of certain areas of the sensor of FIG. 2 with a row of ink dots printed within a certain segment of the gap.

Printer 226 then uses the second uppermost nozzle to print a single-pel-tall row 246 (FIG. 8) of dots across the seventh segment 222 from the left. After printing row 246, the resistance of sensor 190 is monitored by sensor circuit 225. If the second uppermost nozzle actually prints, ASIC 62 reads a positive signal and logs the nozzle as "good" in NVRAM 234.

A single-pel-tall row of seventy pels is printed by all 300 nozzles. After each row is printed, the expected change in resistance of sensor 190 is verified, and the nozzle is logged as being "good" in NVRAM 234. After a row is printed in the last segment 222, i.e., the fortieth or rightmost, of a section 210, the known x-position dislocation is shifted back to the first segment 222, i.e., the first or leftmost, in the next section 210.

When the above process has been completed, a processor, such as ASIC 62, may then process print jobs and adjust printing to account for nozzles which were logged to NVRAM 234 as "bad" or "non-jetting".

Cabling and connectors of the sensor of the present invention are simplified and cost-reduced because the sensor has only two terminals. The sensor base can be made many-up with standard flex-cable manufacturing methods, then processed through a laser cut process to make the one-pel gap.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A sensor for detecting malfunctioning ones of a plurality of nozzles of a printhead in an ink jet printer, said sensor comprising:

at least two terminals defining a single gap therebetween, said single gap having a plurality of substantially linear segments, said segments being displaced from one another in a paper feed direction and in a direction orthogonal to said paper feed direction; and an electrical measuring device configured to detect a change in an electrical resistance between said terminals when ink is in said single gap.

2. The sensor of claim 1, wherein said at least two terminals comprise two terminals.

3. The sensor of claim 1, wherein adjacent said segments are displaced from one another in the paper feed direction by a single pel width.

4. The sensor of claim 1, wherein each said segment has a length of between 10 pels and 300 pels.

5. The sensor of claim 1, wherein each said segment is oriented in a scan direction substantially perpendicular to the paper feed direction.

6. The sensor of claim 1, wherein adjacent ones of the nozzles are displaced from one another by a first distance in the paper feed direction, adjacent said segments being displaced from one another in the paper feed direction by the first distance.

7. The sensor of claim 1, wherein said single gap has a width of approximately one pel.

8. A method of detecting malfunctioning ones of a plurality of nozzles of a printhead in an ink jet printer, said method comprising the steps of:

providing a sensor including at least two terminals defining at least one gap therebetween;

attempting to jet ink from a first of the nozzles into said at least one gap;

measuring a resistance between at least two of said terminals to determine whether the ink has been jetted into said at least one gap; and repeating said attempting and measuring steps for each remaining said nozzle.

9. The method of claim 8, comprising the further step of allowing said ink in said at least one gap to at least one of dry and evaporate between each said measuring step.

10. The method of claim 8, wherein said at least two terminals comprise two terminals, said at least one gap comprising a single, one-pel-wide gap having a plurality of substantially linear segments, said segments being displaced from one another in a paper feed direction, each said segment being oriented in a scan direction substantially perpendicular to the paper feed direction.

11. The method of claim 10, wherein adjacent ones of the nozzles are displaced from one another by a first distance in the paper feed direction, adjacent said segments being displaced from one another in the paper feed direction by the first distance.

12. The method of claim 11, wherein each said attempting step includes attempting to jet ink into a respective one of said segments.

13. The method of claim 12, wherein each said segment has a first length, a first said attempting step including jetting a plurality of sets of side-by-side pels, each said set having a second length one of less than and equal to said first length, said pels within a same said set being aligned in the scan direction, said sets of pels being aligned in the scan direction, a first said measuring step including measuring said resistance after each individual said set of side-by-side pels has been jetted.

14. The method of claim 13, comprising the further step of determining a position in the paper feed direction of said first nozzle based on said measuring steps.

* * * * *